US005392681A

United States Patent [19]

Hall

[11] Patent Number: 5,392,681

[45] Date of Patent: Feb. 28, 1995

[54] DRUM TUNING DEVICE

[75] Inventor: Walter L. Hall, San Bernardino, Calif.

[73] Assignee: Airheads, San Bernardino, Calif.

[21] Appl. No.: 263,805

[22] Filed: Jun. 22, 1994

[51] Int. Cl.[6] ..... G10D 13/02

[52] U.S. Cl. ..... 84/413

[58] Field of Search ..... 84/411 R, 413

[56] References Cited

U.S. PATENT DOCUMENTS 3,240,096 3/1966 Sloan ..... 84/411 R 3,541,913 11/1970 Severino ..... 84/411 R 5,025,697 6/1991 May ..... 84/411 R

*Primary Examiner*—Michael L. Gellner

*Assistant Examiner*—Patrick J. Stanzione

*Attorney, Agent, or Firm*—Poms, Smith, Lande & Rose

[57] ABSTRACT

A drum head tuning apparatus for tuning a drum or similar percussion instrument is disclosed. The invention includes a distensible bladder having an annular shape that is disposed between the drum hoop and the rigid outer circumferential lip of the drum head. When the head is mounted to the drum shell and the hoop is locked down by tensioning members to the lugs on the outside of the shell, air is pumped into the bladder to increased the bladder's volume. The expanding bladder displaces the circumferential lip and consequently pulls the drum head tighter over the opening in the shell to raise the pitch of the drum. Conversely, releasing air pressure from the bladder allows the stretched drum head to spring back thereby releasing tension and lowering the pitch of the drum.

18 Claims, 2 Drawing Sheets

DRUM TUNING DEVICE

BACKGROUND OF THE INVENTION

1. Field of the Invention

The present invention relates to a drum tuning device. More precisely, the present invention relates to a pneumatic, annular bladder positioned adjacent a drum head wherein inflation or deflation of the bladder increases or decreases tension on the drum head thereby tuning the drum.

2. Description of the Prior Art and Related Information

In a conventional percussion instrument such as a snare drum, bass drum, or tom tom, the drum is made from a hollow, tube-shape shell with openings at opposite ends. Each opening is covered by a drum head made from a thin film, which drum head is retained against the rim of the hollow tube shell by a hoop. Actually, the drum head has a relatively rigid circumferential lip which extends over the rim of the shell, and the hoop has a surface which pushes down on the lip. The hoop is secured in place and has its tension adjusted by a plurality of tension rods evenly spaced around the hoop that thread into lugs attached to the outside of the shell.

By advancing the threaded tension rods into the lugs, the hoop is pulled down against the lip of the drum head, thereby stretching the drum head. This action raises the pitch of the drum. Backing off the tension rods reduces the tension in the drum head and correspondingly lowers the pitch of the drum.

One problem with tuning a conventional drum head is that each tension rod must be individually adjusted. This is a time consuming process because it involves tapping the drum head near the tension rod to hear the sound generated in that area as compared to the areas adjacent the other tension rods. The drummer must then continually tap, and then tighten or loosen each tension rod in order to obtain a consistent sound throughout the entire head. Moreover, if the drum has two heads, the bottom head must be tuned before the top head because once the drum is locked down on the drum kit hardware, access to the bottom drum head is severely limited.

There have been developments in the concept of quick-tuning drums. One outgrowth of that concept is a roto-tom. This type of instrument usually has only one drum head held against an abbreviated length shell by a hoop, which hoop pulls the head tightly against the shell. Unique to this design are the tension rods spaced around the hoop, because when the entire drum is rotated, the tension rods collectively tighten thereby uniformly pressuring the drum head against the shell. As a result, rotating the drum in one direction tightens the drum head and counter-rotating the drum head decreases the head tension.

Another method of quickly changing the pitch of drums is disclosed in U.S. Pat. No. 3,590,680 to Carnes et al. Carnes discloses an apparatus for changing the pitch of a drum by conducting pressurized gas into the interior of the drum. Thus, when the drum is pressurized, the pitch is raised; lowering the gas pressure lowers the pitch.

There have been other attempts at using air to affect the pitch of a drum. For instance, U.S. Pat. No. 3,240,096 to Sloan discloses a pneumatic drum head tightener. Sloan uses an annular vellum, inflated with air, that is stretched around the circumference of the drum and acts somewhat as a shock absorber. Specifically, the device enhances the bounce, tonal production, sound volume, and response of the heads through disassociation of the heads from the drum shell, and through the transmission of vibrations of the drum head to the resonant interiors of hollow members within the shell.

U.S. Pat. No. 3,541,913 to Severino discloses an inflated tube that is incorporated into the outside shell of a drum in order to facilitate easy replacement of the drum head. When the captive tube is inflated, it pulls down a collar which acts on the drum head to tighten or loosen the same. This device, however, requires specialized and complicated hardware in order for the inflatable tube to operate properly.

In view of the foregoing, there is a need for a drum tuning device which is easy and quick to use, which provides uniform tuning around the perimeter of the drum head, and which does not require complicated hardware external to the drum. The device should be easily adapted for use on any conventional drum and should not be obtrusive so that it does not interfere with the freedom of movement of the drummer during play.

SUMMARY OF THE INVENTION

Therefore, in view of the foregoing, it is an object of the present invention to provide a drum head tuning apparatus that easily incorporates into pre-existing, conventional drum hardware. It is another object of the present invention to tune the drum quickly and easily. It is another object of the present invention to provide a device to tune drum heads evenly so as not to distort the drum head thereby causing uneven pitches at different places on the drum head. It is still yet another object of the present invention to provide a drum head tuning apparatus that is operated by a fluid, preferably air. It is still another object of the present invention to provide a drum head tuning apparatus that does not require specialized hardware. It is yet another object of the present invention to provide a drum head tuning apparatus that can simultaneously tune both heads of a two-head drum.

In order to achieve the foregoing objects, the present invention provides in a preferred embodiment a drum head apparatus for tuning a drum having a drum head including a lip located at the circumference, a shell with a rim, a hoop, and tensioning members interconnecting the shell to the hoop, the apparatus comprising a distensible annular bladder containing air and having a valve connected to a pump, wherein the drum head is disposed over the rim, the air bladder is disposed over the lip, and the hoop is disposed over the bladder.

In this manner, when air is pumped into the bladder, the bladder expands which moves the lip axially and stretches the drum head more tightly over the shell. Conversely, releasing air from the bladder decreases its volume and relieves tension on the lip thereby relieving tension on the drum head. By inflating or deflating the bladder, the drum head can be tuned up or down quickly.

In an alternative embodiment, the present invention is adapted to fit on a two-head drum. In such a drum, there is a top head and a bottom drum head covering each end of the tubular-shaped drum shell. An annular, distensible top bladder fits over the top drum head while a bottom bladder fits over the bottom drum head. A hoop is used to secure each bladder and drum head against the shell. Optionally, the bladders can be connected to a single valve so that the pitch in both heads can be controlled concurrently. There can also be separate valves for each bladder for independent tuning. A pump is used to pressurize the bladders while the valves bleed off the pressure. Alternatively, a compressed gas source can be used instead of the pump.

The present invention thus provides many advantages over the prior art. First, the drum head can be tuned quickly by a simple valve adjustment to change the internal pressure of the bladder. There is no need to tune each tensioning rod one by one in order to raise or lower the pitch of the drum. This relieves the drummer or his roadie of a very tedious and time consuming task.

Second, tuning is fast so that it may be possible to tune all heads of a drum kit simultaneously if the bladders are interconnected to a single valve. Third, because tuning is fast, it is possible for the drummer to continue playing even while he raises or lowers the pitch of the drums.

Fourth, the present invention does not require new hardware, or complicated and often expensive modifications to conventional drum hardware. Indeed, the present invention easily fits on any conventional drum. Fifth, because of its simple structure, the present invention operates reliably.

Sixth, if a compressed gas canister is used, a drummer can instantaneously increase the pressure of the bladder without physical exertion. In this way, the drummer can concentrate on his playing and not be distracted by having to manually operate a pump.

BRIEF DESCRIPTION OF THE DRAWINGS

The objects, features, and advantages of the present invention will be apparent to one skilled in the art from reading the following detailed description in which.

DETAILED DESCRIPTION OF THE INVENTION

The following specification describes a drum head tuning apparatus. In the description, specific materials and configurations are set forth in order to provide a more complete understanding of the present invention. But, it is understood by those skilled in the art that the present invention can be practiced without those specific details. In some instances, well-known elements are not described precisely so as not to obscure the invention.

The present invention relates to a drum tuning apparatus for tuning a drum having at least one drum head pulled tautly against the rim of a tubular-shape drum shell. In a preferred embodiment, the present invention includes a distensible bladder having an annular shape, which is positioned adjacent the outer circumferential lip of the drum head and held in place by a rigid hoop. In an alternative embodiment, the bladder can be one or more bent sections that are inserted under only a portion of the drum hoop.

The bladder in the preferred embodiment has a circular cross-section. Of course other cross-sectional shapes are possible.

When the drum head and hoop are forced against the drum shell and the hoop is tightened against the drum shell by tensioning members, the distensible bladder is squeezed between the drum head lip and the hoop. When a fluid such as air is pumped into the bladder, the bladder increases its cross-sectional size. It should be noted that it is important that the annular circumference of the tube does not significantly increase with respect to its position relative to the lip and the hoop; rather, it is the cross-sectional area which increases.

On one side of the bladder, the hoop cannot be displaced by the expanding bladder because it is held in place by the tensioning members. On the other side, expansion of the bladder displaces the rigid, circumferential lip of the drum head, forcing it to move away from the hoop, and consequently pulling the drum head down more tightly across the rim of the shell. The increased stretching raises the pitch of the drum.

Conversely, releasing the air pressure from inside of the bladder decreases its volume. The natural springback in the stretched drum head pulls the lip, which was previously deformed, back toward its initial position. As a result, the drum head loses its tension and the pitch of the drum is lowered.

Figure 1:
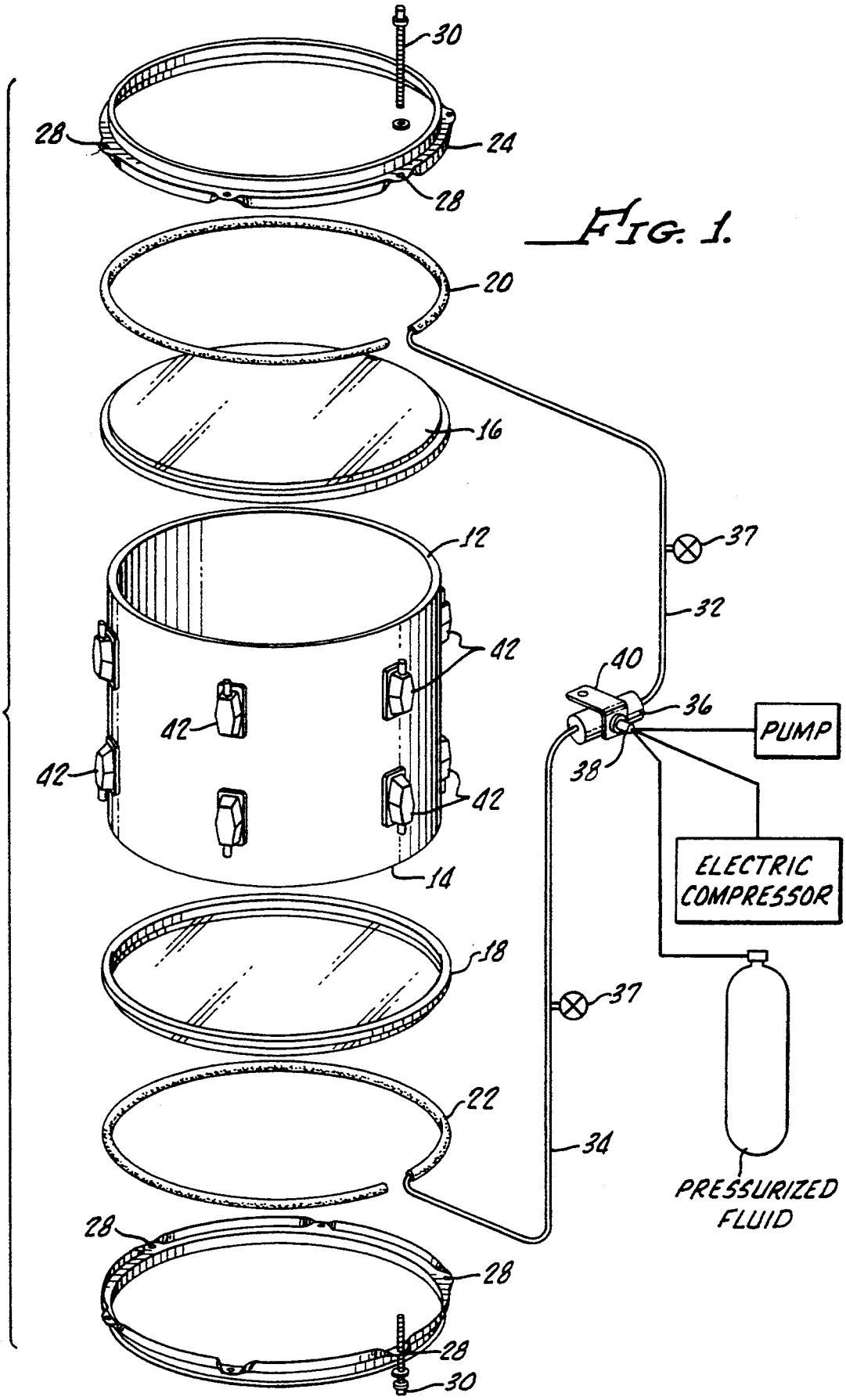
FIG. 1 is a perspective exploded view of a preferred embodiment of the present invention adapted for use on a two-head drum.

FIG. 1 provides an exploded, perspective view of a preferred embodiment of the present invention drum head tuning apparatus. In this illustration, the invention is adapted for use in a conventional, two-head drum, such as a tom tom. Naturally, the present invention is easily incorporated into any conventional drum or like percussion instrument, regardless of the number of heads. Indeed, in many drum kits, there is only a single drum head on the top side, which is the drum head that is struck to generate the sound, known as the batter. To be sure, the present invention is well suited for bongos, snare drums, tom toms of all shapes and sizes, timbales, tympani, congas, bass drums, etc.

FIG. 1 shows a drum of a conventional two-head design having a hollow cylindrical shell 10, with openings at both ends. The openings of the shell 10 have a beveled or rounded rim 12 and 14. Covering each opening is a top drum head 16 and a bottom drum head 18. Disposed adjacent the top and bottom drum heads 16, 18 are annular shaped, distensible bladders 20 and 22.

Securing the distensible bladders 20, 22 against the top and bottom drum heads 16, 18 are a top hoop 24 and a bottom hoop 26. The hoops are typically made from a rigid material such as stamped steel or a cast metallic alloy.

Evenly spaced around the circumference of each of the top and bottom hoops 24, 26 are eyelets 28 through which corresponding tensioning members 30 pass. The tensioning member 30 is preferably a threaded rod with a bolt head that matches the socket head of a drum key. Other tensioning devices known in the drum art can be used as well.

As seen in the top head, the purpose of the tensioning members 30 and the hoop 24 is to hold the drum head 16 against the rim 12. In conventional drums, the lengths of the tensioning members 30 and the space adjacent the lip 44 and the hoop 24 are sufficient to accommodate insertion of the bladder 20, 22 therebetween. Thus, the present invention is easily incorporated into any drum.

Optional feed lines 32, 34 connect the bladders 20, 22 to a control valve 36. The control valve 36 is connected to a pump (not shown) and is designed to regulate inlet and outlet of air in and out of the bladders 20, 22. A valve stem 38 permits connection to the pump. The pump can be of any design known in the art including an electric compressor, or even a foot operated bellows. Conveniently, the control valve 36 preferably has a mounting bracket 40 which has a hole that aligns with one of the eyelets 28 on a hoop for mounting thereto.

In an alternative embodiment, the present invention provides a compressed gas canister in lieu of the pump. This way, the drummer need not physically pump fluid into the bladder; rather, he can simply open a valve to release the compressed fluid to increase pressure in the bladder.

In another alternative embodiment, the present invention drum tuning apparatus may have more than one control valve so that each head can be tuned independently. In yet another alternative embodiment, some or all drum heads in a single drum kit can be tuned simultaneously. This is accomplished by using feed lines to interconnect all of the bladders in the drum kit and regulating the pressure through a single valve.

In the embodiment shown in FIG. 1, the exterior of the drum shell 10 includes lugs 42 into which the threaded tensioning members 30 can be screwed. In the exemplary embodiment, a single lug accepts a corresponding tensioning member 30 from the top and from the bottom. In an alternative embodiment, there can be separate lugs for each tensioning member and the top and bottom lugs do not necessarily have to be in one integral unit. In yet another alternative embodiment, the lugs 42 need not be attached to the shell. In this embodiment, the lugs float freely and are not attached to the shell exterior.

Figure 2:
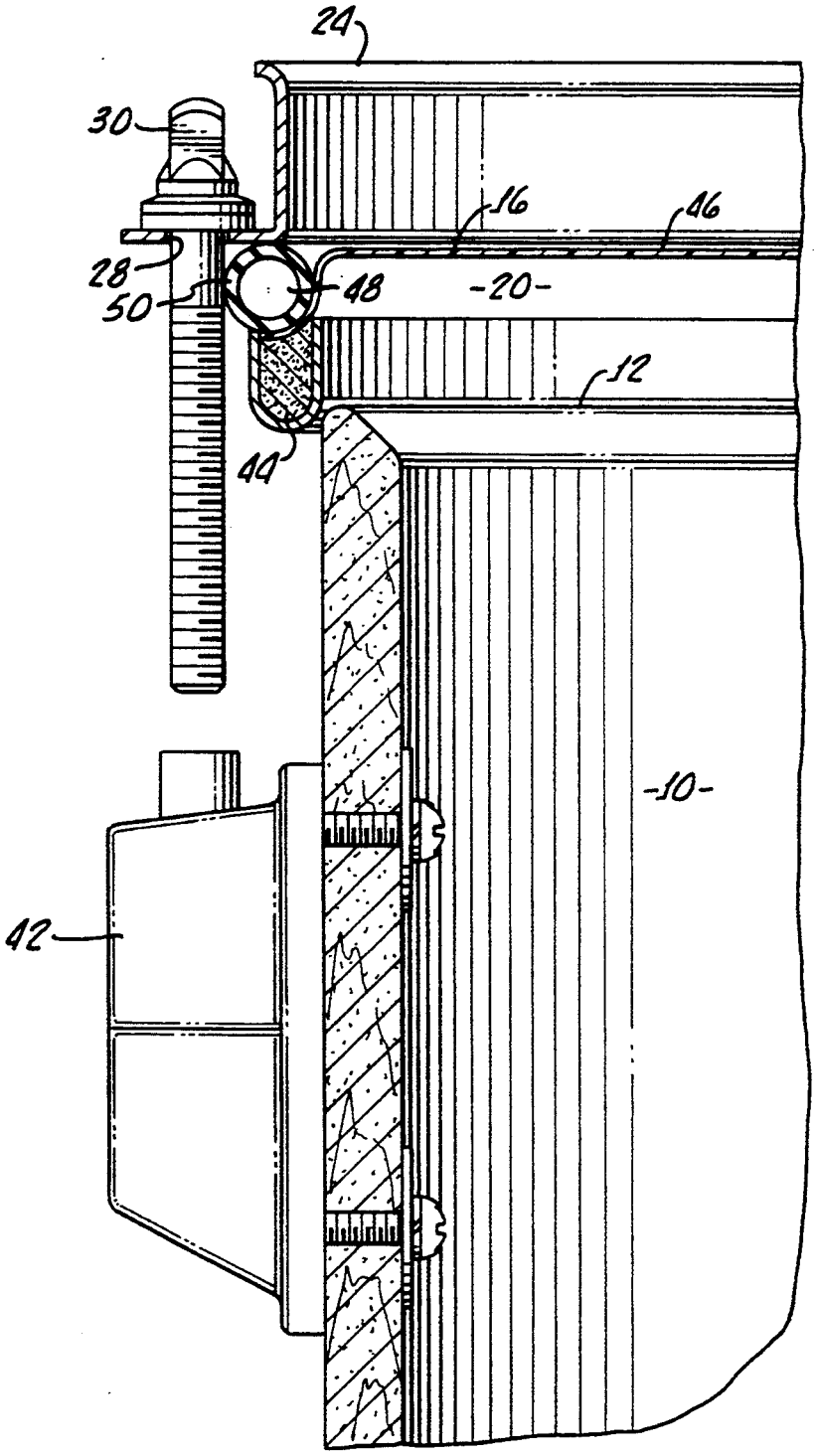
FIG. 2 is a partial cross-sectional view of the present invention showing the distensible bladder positioned between the drum head and the hoop.

FIG. 2 is an enlarged, partial sectional view of the present invention wherein the major components are assembled except for the tensioning member 30 which has not yet been threaded into the corresponding lug 42. In this view, the shell 10 is partially cut away. It is important to note that the present invention is easily adaptable to any material drum shell including wood, fiberglass, metal, or any polymer or composite material. Furthermore, the number of laminates used to make the shell does not affect the performance of the present invention.

At the opening of the shell 10 is the rim 12 on which the drum head 16 seats. The drum head 16 is of a conventional design having a reinforced circumferential lip 44. Usually, the reinforced circumferential lip 44 is made of a metal such as aluminum, which gives the drum head 16 its rigidity around its outer edge. The skin 46 of the drum head wraps around the reinforced circumferential lip 44 and covers the opening of the shell 10. Typically, the skin is made from a Mylar or a similar stretchable polymer. The present invention is easily adaptable for use with a variety of drum heads including laminated drum heads, hydraulic drum heads, etc.

Directly adjacent to the reinforced circumferential lip 44 is the preferred embodiment distensible bladder 20. As seen in FIG. 2, the bladder 20 has a hollow interior 48 surrounded by a pliant, distensible wall 50. It is disposed adjacent the reinforced circumferential lip 44 and is held in place by the hoop 24. When the tensioning members 30, of which only one is shown in FIG. 2, are advanced into the corresponding lugs 42, the bladder 20 is squeezed between the bottom of the hoop 24 and the rigid lip 44.

The drummer at this time carefully ensures that the drum head 16 is properly seated on the rim 12. When a pressurized fluid moves into the hollow interior 48 of the bladder 20, the bladder expands in volume. Because the hoop 24 is held by the tensioning members 30, it cannot be moved away from the drum shell. Therefore, the expanding bladder 20 forces the reinforced lip 44 downward. As the lip 44 is forced downward, it continuously stretches the skin 46 tighter and tighter over the rim 12. Accordingly, the pitch of the drum is increased.

Conversely, bleeding the fluid from inside the bladder 20, through optional bleed valve 37, decreases its size. As a result, the natural spring back in the stretched skin 46 of the drum head 16 pulls the lip 44 back towards its initial position, thus relieving tension in the skin and lowering the pitch of the drum.

Preferably, the distensible bladder 20 has a circular cross-section, but other cross-sectional shapes can be used depending upon purpose. It is further preferable that the bladder 20 be made from a stretchable, pliant material such as rubber or like elastomeric material. Of course, other pliant materials known in the art can be used.

The fluid used to inflate and deflate the bladder 20 is preferably air. Other fluids, such as incompressible liquids, can be used if tighter control of tuning is necessary.

In the exemplary embodiment shown in FIG. 1, it is possible to use the single control valve 36 to adjust the interior pressure in both the top and bottom bladders 20, 22, thereby adjusting the tone of the drum instantly and quickly. The present invention thus obviates the need to flip the drum over in order to access the tensioning members 30 to adjust the tension of the bottom drum head 18. This saves the drummer from having to disassemble the drums from his drum kit. Furthermore, in a snare drum where the snares are pulled across the bottom drum head, it is inconvenient to adjust the bottom drum head. The present invention provides a quick solution to this inconvenience.

In addition, many drummers prefer that the two heads of the drum be stretched to different pitches. This can be accomplished by simply adding another control valve to the system. Therefore, the top distensible bladder and the bottom dispensable bladder can have different pressures as regulated by the individual control valves.

What is claimed is:

1. A drum head tuning apparatus for tuning a drum having a drum head including a lip, a shell with a rim, a hoop, and tensioning members connecting the shell to the hoop, the apparatus comprising:

a distensible bladder for containing pressurized fluid; and a valve connected to the bladder for controlling the amount of pressurized fluid in the bladder;

wherein the bladder is sized to be disposed over the lip, and the hoop is disposed over the bladder in fixed positional relationship to the shell;

whereby conveying pressurized fluid into the bladder increases the size thereof, which moves the lip away from the hoop and stretches the drum head, and whereby releasing fluid from the bladder decreases the size of the bladder and allows the lip to move toward the hoop and thereby relieves tension on the drum head.

2. The apparatus of claim 1, further including a second drum head tuning apparatus and a feed line in fluid communication with both valves of each tuning apparatus.

3. A drum with a tuning apparatus comprising:

a cylindrical shell having a top rim;

a top drum head having a lip at a circumference thereof, disposed over the top rim;

a distensible annular hollow tube containing a fluid, disposed over the lip in a mating relationship;

a top hoop disposed over the tube in contacting relationship; and a source of pressurized fluid for conveying fluid into and out of the distensible tube.

4. The drum of claim 3, wherein the shell has a bottom rim, and the drum further comprises a bottom drum head having a lip, a distensible bottom bladder, a bottom hoop, wherein the bottom drum head is disposed over the bottom rim, the bottom bladder is disposed under the lip, and the bottom hoop is disposed under the bottom bladder.

5. The drum of claim 4, wherein the apparatus further comprises a plurality of tensioning members and corresponding lugs, and wherein the tensioning members hook the hoops and thread into the lugs.

6. The drum of claim 5, wherein the lugs are attached to the shell.

7. The drum of claim 6, wherein the distensible top bladder has a circular cross-sectional shape.

8. The drum of claim 7, wherein the top bladder and the bottom bladder are in fluid communication with a control valve.

9. The drum of claim 8, wherein the fluid includes air.

10. The drum of claim 9, wherein the fluid comprises a liquid.

11. The drum of claim 7, wherein the top bladder includes a control valve and the bottom bladder includes a control valve.

12. The drum of claim 7, wherein the pump includes an electric compressor with a bleed valve.

13. The drum of claim 3, wherein the drum further comprises a plurality of tensioning members and corresponding lugs, and wherein the tensioning members engage the hoop and thread into the lugs, which lugs are attached to the shell, whereby the hoop is fixed relative to the shell.

14. A drum head tuning apparatus for tuning a drum having a top drum head and a bottom drum head including a lip at the circumference of each drum head, a tubular shell with a top rim and a bottom rim at opposite ends, a top hoop and a bottom hoop, and tensioning members interconnecting the hoops, the apparatus comprising:

a distensible top annular hollow tube containing air;

a pump having a valve in fluid communication with the top tube;

wherein the top drum head is disposable over the rim, the top tube is disposable over the lip, and the top hoop is disposable over the tube;

whereby pumping air into the top tube increases the cross-sectional size thereof, which displaces the lip and stretches the top drum head, and whereby releasing air from the bladder decreases its cross-sectional size and relieves tension on the lip and thereby relieves tension on the top drum head.

15. The drum head of claim 14, wherein the apparatus further comprises a distensible bottom bladder, wherein the bottom bladder is in fluid communication with the valve and the pump, and wherein the bottom drum head is disposed on the bottom rim, the bottom bladder is disposed under the lip of the bottom drum head, and the bottom hoop is disposed under the bottom bladder.

16. The drum head of claim 15, wherein the tensioning members further comprise tensioning rods threaded into corresponding lugs attached to the shell.

17. The drum head of claim 14, wherein the apparatus further comprises feed lines extending from the top bladder to the valve and extending from the bottom bladder to the valve.

18. A drum head tuning apparatus for tuning a drum head, wherein said drum head has a peripheral circumferential lip which extends over the rim of the cylindrical drum shell, a hoop which is circumferentially disposed about the drum head and drum shell, and tensioning members for interconnecting the shell to the hoop, and thus fixing the positional relationship between the hoop and the shell, wherein the apparatus comprises:

a distensible annular hollow tube sized to match the circumference of the drum head lip and to be positioned between the drum head lip and a circumferential surface of the hoop in touching relationship to both; and a valve connected to the annular tube for directing a pressurized fluid into or out of the annular tube;

whereby directing the fluid into the annular tube causes it to increase in cross-sectional diameter, thereby increasing the force pushing the lip away from the hoop, and thus causing the drum head to be stretched tighter.

* * * * *